US006471558B1

(12) United States Patent
Nakatsuji et al.

(10) Patent No.: US 6,471,558 B1
(45) Date of Patent: Oct. 29, 2002

(54) VENTILATION SYSTEM FOR WATERCRAFT

(75) Inventors: Akira Nakatsuji; Satoshi Koyano; Tomoyoshi Koyanagai, all of Iwata (JP)

(73) Assignee: Yamaha Hatsudoki Kabushiki Kaisha (JP)

( * ) Notice: Subject to any disclaimer, the term of this patent is extended or adjusted under 35 U.S.C. 154(b) by 0 days.

(21) Appl. No.: 09/675,344

(22) Filed: Sep. 28, 2000

(30) Foreign Application Priority Data

Sep. 28, 1999 (JP) ..... 11-274073

(51) Int. Cl.[7] ..... B63H 21/32

(52) U.S. Cl. ..... 440/88; 114/55; 114/5

(58) Field of Search ..... 440/88, 89, 38; 114/55.5

(56) References Cited

U.S. PATENT DOCUMENTS

| | | | | |
|---|---|---|---|---|
| 3,158,129 A | | 11/1964 | Mauer | |
| 3,397,670 A | | 8/1968 | Bedford | |
| 3,826,220 A | | 7/1974 | Jacobson | |
| 3,948,206 A | | 4/1976 | Tyler | |
| 4,846,300 A | * | 7/1989 | Boda | 440/88 |
| 4,945,852 A | | 8/1990 | Kobayashi | |
| 4,952,180 A | | 8/1990 | Watanabe et al. | |
| 4,968,276 A | | 11/1990 | Hashimoto | |
| 4,982,682 A | | 1/1991 | Hattori | |
| 4,984,528 A | | 1/1991 | Kobayashi | |
| 4,986,208 A | | 1/1991 | Kobayashi | |

(List continued on next page.)

FOREIGN PATENT DOCUMENTS

| | | |
|---|---|---|
| JP | 61-61782 | 9/1987 |
| JP | 64-238828 | 4/1991 |

OTHER PUBLICATIONS

Parts Catalog, SEA DOO 2001, XP 5530/5531.
Photos of Model Year 2001, SEA DOO XP.
Parts Catalog, SEA DOO 2001, GTX 5526/5527/5538/5539.
Photos of Model Year 2001, SEA DOO GTX.
Coast Guard, Department of Transportation, 33 CFR § 183.620–33 CFR § 183.630.
Parts Catalogue, Wave Raider, Model Year 1997, RA700BV (GJ85).
Wave Blaster Parts Catalogue, Model Year 1996.
Yamaha Marine, Water Vehicles Super Jet (EW2) Parts Catalogue.
Parts Catalogue, Wave Runner VXR, Model Year 1995.
Co–pending patent application: Serial No. 09/280,262, filed Mar. 29, 1999, titled Engine Compartment for Personal Watercraft, in the name of Toshiyuki Hattori.
Co–pending patent application: Serial No. 09/595,676, filed Jun. 19, 2000 titled Vapor System Arrangement for Marine Engine in the name of Masayoshi Nanami.

(List continued on next page.)

*Primary Examiner*—Jesus D. Sotelo
(74) *Attorney, Agent, or Firm*—Knobbe, Martens, Olson & Bear, LLP.

(57) ABSTRACT

A watercraft includes a ventilation system for ventilating the engine compartment and for providing air for induction into the watercraft engine. An air duct extends through the hull and communicates with the engine compartment. An induction box is attached to a deck of the hull and encloses a space around the air duct. The induction box is sized so that pressure pulses are dissipated within the box. A portion of an outer edge of the induction box is cut way, forming an opening through which air can flow. A cowling substantially covers the induction box. Another structural aspect includes a pair of air ducts, each having an associated induction box. An opening of one induction box is generally forwardly facing. An opening of the other induction box is generally rearwardly facing.

66 Claims, 7 Drawing Sheets

U.S. PATENT DOCUMENTS

| | | | | | |
|---|---|---|---|---|---|
| 5,122,419 | A | | 6/1992 | Kurato et al. | |
| 5,255,626 | A | | 10/1993 | Hattori et al. | |
| 5,390,621 | A | | 2/1995 | Hattori et al. | |
| 5,490,474 | A | * | 2/1996 | Ikeda | 440/89 |
| 5,588,887 | A | | 12/1996 | Ikeda | |
| 5,619,950 | A | | 4/1997 | Ikeda | |
| 5,664,515 | A | * | 9/1997 | Hattori et al. | 440/88 |
| 5,743,228 | A | | 4/1998 | Takahashi | |
| 5,752,867 | A | | 5/1998 | Koyanagi | |
| 5,873,322 | A | | 2/1999 | Koyanagi | |
| 5,879,211 | A | | 3/1999 | Koyanagi | |
| 5,902,158 | A | | 5/1999 | Nakase et al. | |
| 5,957,072 | A | | 9/1999 | Hattori | |
| 6,015,320 | A | | 1/2000 | Nanami | |
| 6,015,321 | A | | 1/2000 | Ozawa et al. | |
| 6,022,253 | A | | 2/2000 | Ozawa et al. | |
| 6,089,932 | A | | 7/2000 | Nanami et al. | |
| 6,095,877 | A | | 8/2000 | Kawamukai et al. | |
| 6,139,381 | A | | 10/2000 | Suzuki et al. | |
| 6,296,536 | B1 | | 10/2001 | Katayama et al. | |

OTHER PUBLICATIONS

Parts Catalogue, Super Jet, Model Year 1999, SJ700AX (GM6D).

Parts Catalogue, Model Year 1999, Wave Venture, XL700X (F0M1).

Parts Catalogue, Model Year 1998, GP1200W (GP85).

Yamaha Genuine Parts Catalogue Water Vehicle, Model Year 1998.

Parts Catalogue, Model Year 1998, XL1200W (GU31).

Parts Catalogue, Model Year 2000, "GP1200R", GP1200AY(FOX1).

Parts Catalogue, Model Year 2000, LS2000, LST1200Y (FOR2).

Parts Catalogue, Model Year 2000, "XR1800", XRT1200Y (F0C1).

Parts Catalogue, Model Year (1999), Exciter EXS1200X (F0Y1).

Parts Catalogue, Model Year 2000, Wave Runner, GP760Y.

Parts Catalogue, Model Year 2000, SUV1200, SV1200Y (GU52).

Parts Catalogue, Model Year 2000, Wave Runner, XL1200Y (F0D5).

Parts Catalogue, Model Year 2000, Wave Runner XL, XL700Y (F0M5).

Parts Catalogue, Model Year 1999, SUV 1200, SV1200X (GU51).

Parts Catalogue, Model Year 1999, Wave Runner, GP1200X (GP89).

* cited by examiner

VENTILATION SYSTEM FOR WATERCRAFT

PRIORITY INFORMATION

This application is based on and claims priority to Japanese Patent Application No. 11-274073, filed Sep. 28, 1999, the entire contents of which is hereby expressly incorporated by reference.

BACKGROUND OF THE INVENTION

1. Field of the Invention

The present invention relates to a small watercraft, and more particularly to a ventilation system for a small watercraft.

2. Description of Related Art

Personal watercraft have become very popular in recent years. This type of watercraft is quite sporting in nature and carries a rider and possibly one, two, three or four passengers. A relatively small hull of the personal watercraft commonly defines a riders' area above an engine compartment. An internal combustion engine frequently powers a jet propulsion unit which propels the watercraft. The engine lies within the engine compartment in front of a tunnel formed on the underside of the watercraft hull. The jet propulsion unit is located within the tunnel and is driven by the engine.

Air ducts typically communicate air into the engine compartment for induction by the engine and to ventilate the engine compartment. Typically, such air ducts are covered by a hatch cover or the like. This arrangement has resulted in problems such as excessive noise generation during air intake, as well as excessive engine noise communicated from the engine compartment to the outside.

SUMMARY OF THE INVENTION

A need therefore exists for an improved engine compartment air intake arrangement that reduces noise generated during air intake and that reduces noise communicated from the engine compartment to the outside while providing adequate ventilation of the engine compartment.

In accordance with a first aspect, the present invention includes a watercraft comprising a hull defining an engine compartment, an internal combustion engine located within the engine compartment and having an output shaft, a propulsion device carried by the hull and connected to the engine output shaft, an exhaust system for delivering exhaust gases from the engine to the environment, an air duct extending through the hull and into the engine compartment, and an induction box attached to the hull and enclosing an interior space. The induction box has an opening thereinto and an outer edge that abuts the hull. Also, the induction box is sized such that pressure pulses of air flowing therethrough are dissipated within the box.

In accordance with another aspect of the present invention, a watercraft is provided having a hull defining an engine compartment, an internal combustion engine located within the engine compartment and having an output shaft, a propulsion device carried by the hull and connected to the engine output shaft, an exhaust system for delivering exhaust gases from the engine to the environment, a first and a second air duct extending through the hull and into the engine compartment, a first induction box enclosing a first induction space around the first duct, and a second induction box enclosing a second induction space around the second duct. The first and second air ducts are positioned at substantially the same longitudinal position relative to the hull.

Also, the first induction box has a forwardly facing opening, and the second induction box has a rearwardly facing opening.

Further aspects, features, and advantages of the present invention will become apparent from the detailed description of the preferred embodiment which follows.

BRIEF DESCRIPTION OF THE DRAWINGS

The above-mentioned and other features of the invention will now be described with reference to the drawings of a preferred embodiment of the present watercraft. The illustrated embodiment of the watercraft is intended to illustrate, but not to limit, the invention. The drawings contain the following figures.

DETAILED DESCRIPTION OF THE PREFERRED EMBODIMENT

FIGS. 1 through 8 illustrate a personal watercraft 10 that includes a ventilation system configured in accordance with a preferred embodiment of the present invention. Although these features are illustrated in connection with a personal watercraft, the features can be used with other types of watercraft as well, such as, for example, but without limitation, small jet boats and the like.

The following describes the illustrated watercraft in reference to a coordinate system in order to ease the description of the watercraft 10. A longitudinal axis extends from bow to stem and a lateral axis extends from port side to starboard side normal to the longitudinal axis. A vertical axis extends normal to both the longitudinal axis and the lateral axis. In addition, relative heights are expressed in reference to an undersurface of the watercraft hull. And in FIG. 1, a label "Fr" has been included and designates a forward direction for reference purposes.

Figure 1:
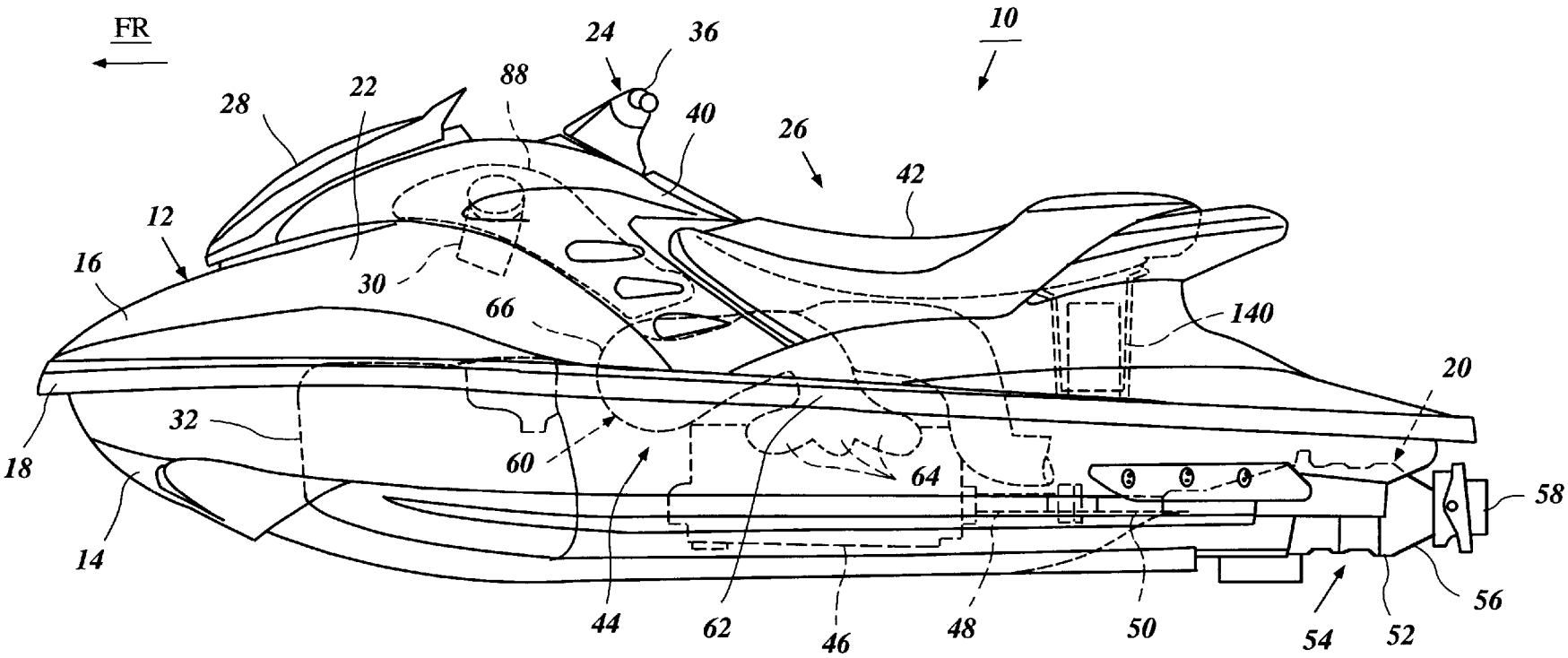
FIG. 1 is a side elevational view of a personal watercraft configured in accordance with a preferred embodiment of the present invention, showing certain components in phantom.
Figure 2:
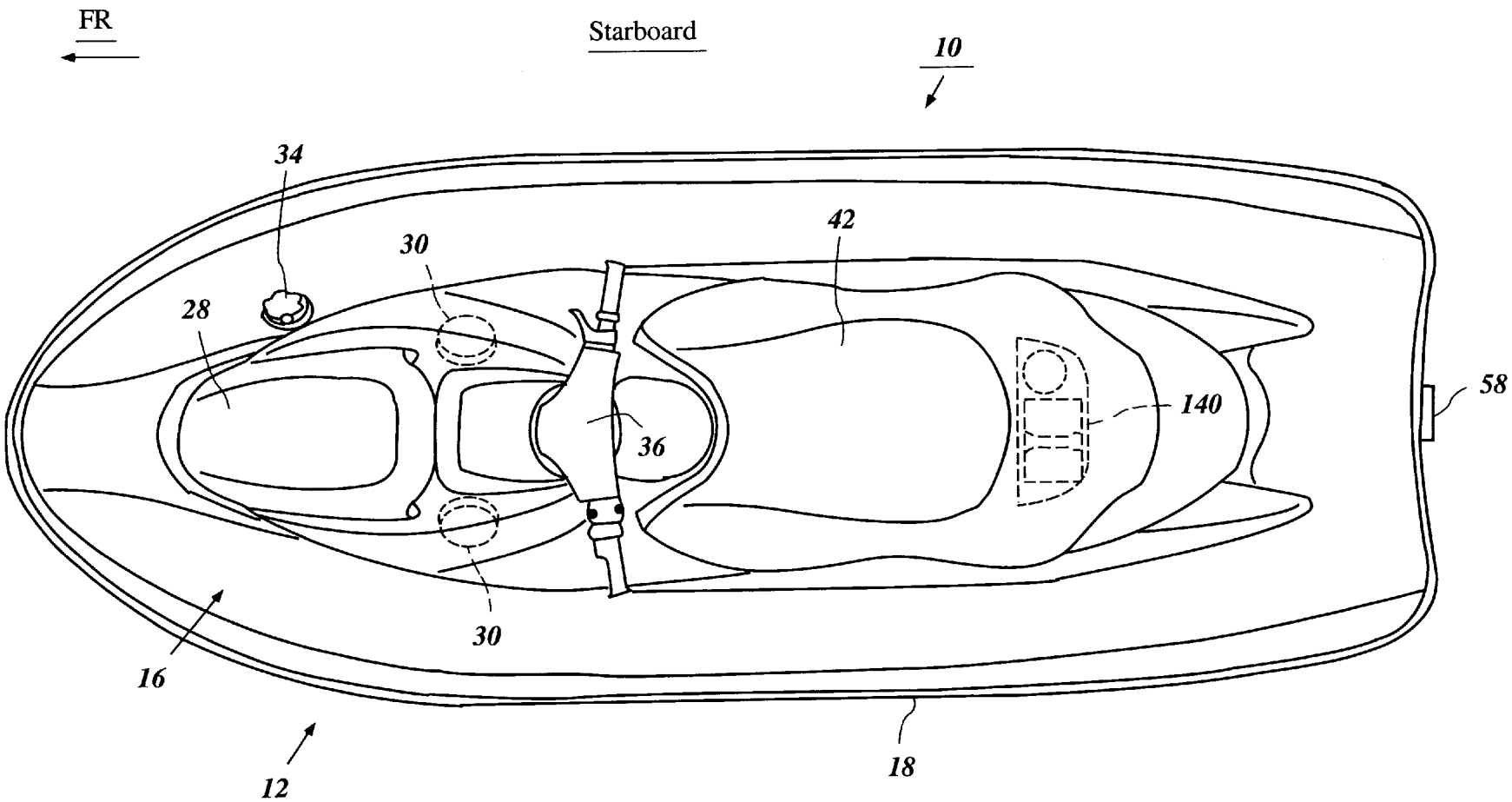
FIG. 2 is a top plan view of the personal watercraft of FIG. 1.

With initial reference to FIGS. 1 and 2, the watercraft 10 includes a hull body 12 formed by a lower hull 14 and a deck 16. The lower hull 14 and the deck 16 are formed from a suitable material such as, for example, a molded fiberglass reinforced resin or SMC. The lower hull 14 and the deck 16 are fixed to each other around the peripheral edges in any suitable manner.

In the illustrated embodiment, a bond flange 18 is defined as the overlapping mating section where the lower hull 14 and the deck 16 are joined together. The bond flange 18 also identifies the location of a bond line, which is an imaginary line around the watercraft 10 where the hull 14 and the deck 16 are joined together. Accordingly, the deck 16 generally comprises the upper structural body of the watercraft 10, which includes the upper bond flange 18.

The lower hull is designed such that the watercraft 10 planes or rides on a relatively small surface area at the aft end of the lower hull 14 in order to optimize the speed and handling of the watercraft 10 when up on plane. For this purpose, the lower hull 14 generally has a V-shaped configuration formed by a pair of inclined sections that extend outwardly from a keel line of the hull to the hull's side walls at a dead rise angle. The inclined sections also extend longitudinally from the bow toward the transom of the lower hull 14. The side walls are generally flat and straight near the stern of the lower hull and smoothly blend towards the longitudinal center of the watercraft at the bow. The lines of intersection between the inclined section and the corresponding side wall form the outer chines of the lower hull 14.

Toward the transom of the watercraft, a recessed channel or tunnel 20 is formed and extends generally upward toward the deck 16 and opens through the rear of the transom of the watercraft 10.

With more specific reference to FIG. 1, the deck 16 includes a bow portion 22, a control mast 24 and a rider's area 26, as viewed in the direction from the bow to the stern of the watercraft 10. The bow portion 22 slopes upwardly toward the control mast 24. A hatch cover 28 desirably extends above a storage compartment formed in the hull 14. Air ducts 30 are formed through the deck 16 and allow air to enter and/or exit compartments within the interior of the hull 14. The structure and operation of the ducts 30 will be described in more detail below.

With reference also to FIG. 2, a fuel tank 32 is located within a forward portion of the hull 12 beneath the hatch cover 28. Conventional means, such as, for example, straps, secure the fuel tank 32 to the lower hull 14. A fuel filler hose (not shown) extends between a fuel cap 34 and the fuel tank 32. In the illustrated embodiment, the filler cap 34 (not shown) is secured to the bow portion 22 of the hull upper deck 16 to the side and in front of the control mast 24.

With reference again to FIGS. 1 and 2, the control mast 24 extends from the bow portion 22 and supports a handlebar assembly 36. The handlebar assembly 36 controls the steering of the watercraft 10 in a conventional manner. The handlebar assembly 36 also carries a variety of controls of the watercraft 10, such as, for example, a throttle control, a start switch and a lanyard switch. In the illustrated embodiment, a cowling 40 covers a portion of the deck 16. The deck 16 supports a steering column to which the handlebar assembly 36 is attached, at a point beneath the cowling 40.

A display panel (not shown) desirably is located in front of the control mast 24 on the bow portion 22 and is orientated to be visible by the rider. The display panel desirably displays a number of performance characteristics of the watercraft, such as, for example, watercraft speed (via a speedometer), engine speed (via a tachometer), fuel level, oil level, engine temperature, battery charge level and the like.

The rider's area 26 lies behind the control mast 24 and includes a seat assembly 42. In the illustrated embodiment, the seat assembly 42 has a longitudinally extending straddle-type shape that may be straddled by an operator and by at least one, two or three passengers.

At least a portion of the hull forms an engine compartment 44 that is located primarily below the seat 42 and encloses an internal combustion engine 46, which supplies propulsive force to the watercraft 10. In the illustrated embodiment, the engine 46 comprises a four cycle, three cylinder, inline engine and is disposed so that its cylinder bores are inclined slightly to one side of vertical. While the illustrated engine is of the four-cycle variety, the engine also can be of the two-cycle or rotary variety as well. Moreover, the engine can have one, two or more than three cylinders and can be formed with two banks of cylinders.

The engine 46 drives an output shaft 48 which is coupled to an impeller shaft 50. The impeller shaft 50 drives an impeller within an impeller housing assembly 52 of a jet propulsion unit 54, which is mounted within the tunnel 20. The impeller housing assembly 52 also acts as a pressurization chamber and delivers the water flow from the impeller housing to a discharge nozzle 56.

A steering nozzle 58 is supported at the downstream end of the discharge nozzle 56 by a pair of vertically extending pivot pins. In an exemplary embodiment, the steering nozzle 58 has an integral lever on one side that is coupled to the handlebar assembly 36 through, for example, a bowden-wire actuator, as known in the art. In this manner, the operator of the watercraft 10 can move the steering nozzle 58 to effect directional changes of the watercraft 10.

An exhaust system 60 discharges exhaust byproducts from the engine 46 to the atmosphere and/or to the body of water in which the watercraft 20 is operated. The exhaust system 60 includes in exhaust manifold 62 that is affixed the side of the engine cylinder block and which receives exhaust gases from the combustion chambers through exhaust ports in a well-known manner. For this purpose, the exhaust manifold 62 desirably includes a number of runners 64 equal in number to the number of cylinders. Each runner communicates with the exhaust port(s) of the respective cylinder. The runners of the exhaust manifold thence merge together at a merge point to form a common exhaust path that terminates at an outlet end of the manifold 62.

An outlet end of the exhaust manifold communicates with an exhaust expansion chamber 66, which wraps around the front side of the engine 46 and extends along an opposite side of the engine 46 to a point just beyond the rear side of the engine 46. The expansion chamber 66 then turns downward and communicates with a water trap (not shown). A discharge conduit (not shown) extends from the water trap in a known manner to an exhaust discharge port formed through the hull in the tunnel.

While not illustrated, the engine also includes an induction system that provides air to each combustion chamber for combustion. The induction system can be configured in any suitable manner and may provide either an air charge (i.e., for direct injection engines or for engines having fuel injected into scavenge passages) or a mixed air-fuel charge (i.e., for indirect injection engines or carbureted engines). Thus, the induction system draws air from the compartments defined within the hull into the engine. Further description of the induction system is not necessary to enable those of ordinary skill in the art to make and use the present invention.

Figure 3:
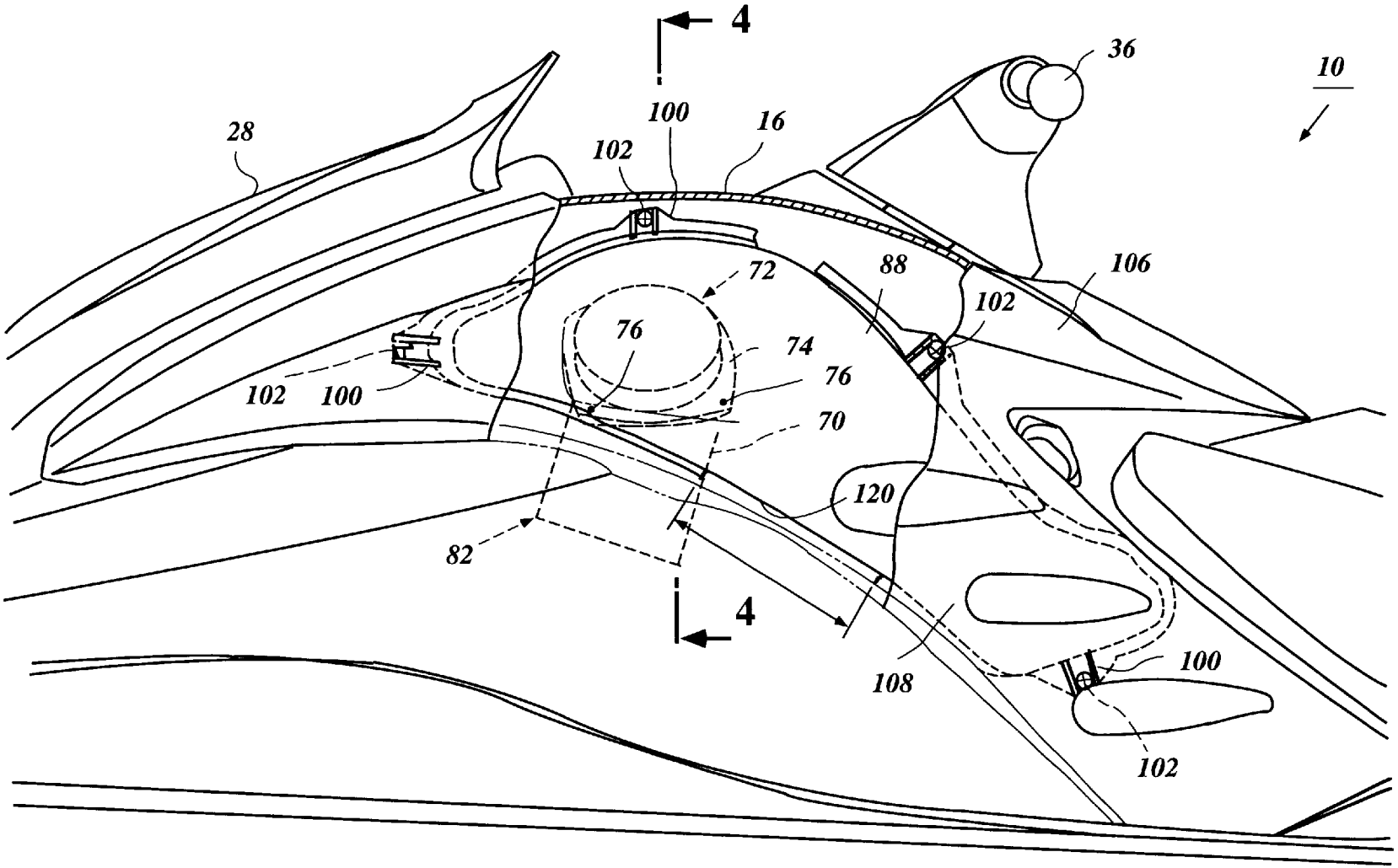
FIG. 3 is a close up side view of a portion of the personal watercraft of FIG. 1.
Figure 4:
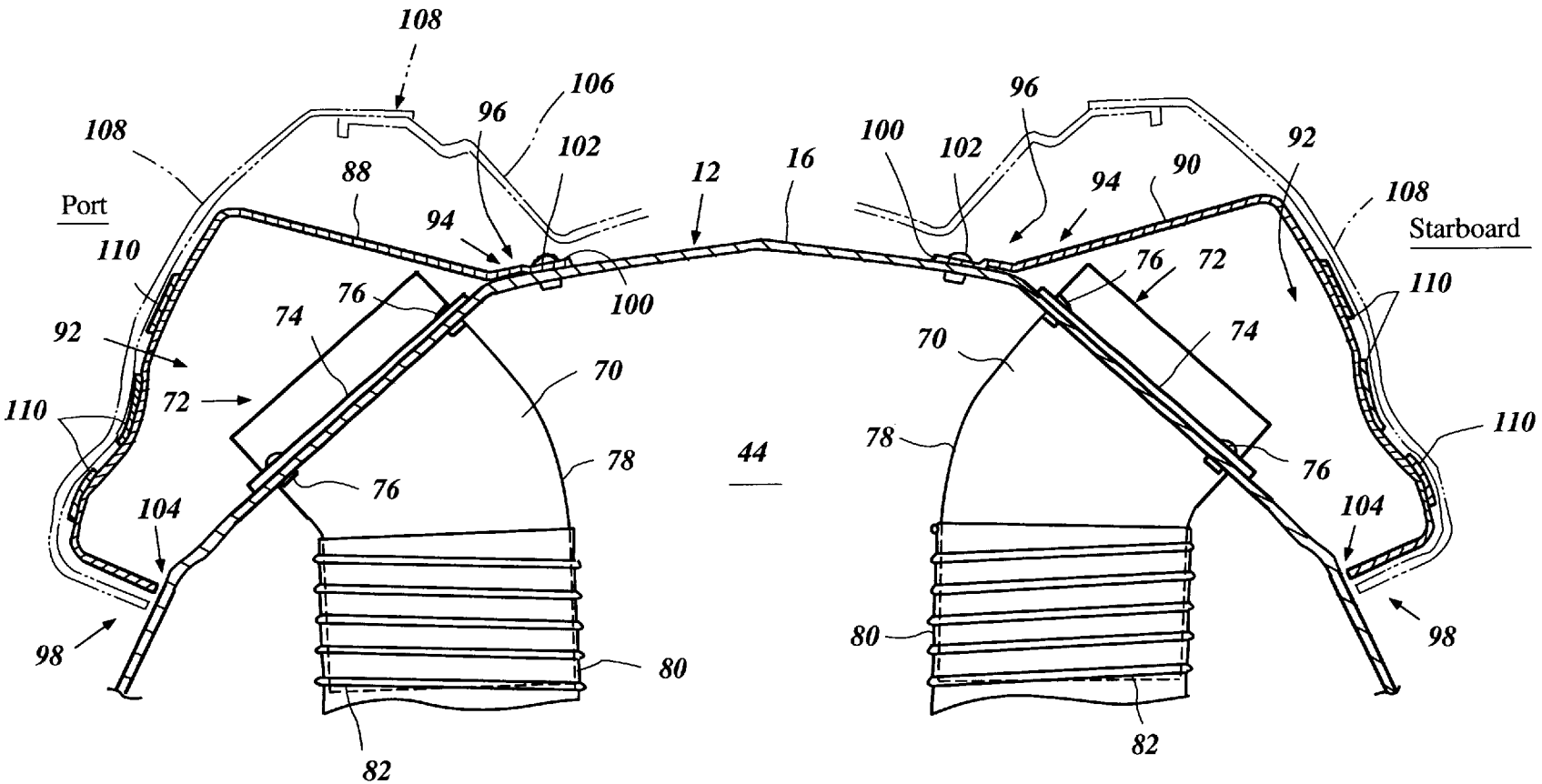
FIG. 4 is a cross-sectional view taken along line 4—4 of FIG. 3.

With more specific reference to FIGS. 3 and 4, the illustrated air ducts 30 each comprise a pipe 70 extending through the deck 16 and terminating at a first end 72. A flange 74 disposed around the pipe 70 abuts a portion of the deck 16. Fasteners, such as rivets 76, for example, extend through the flange 74 and secure the pipe 70 to the deck 16.

An elbow 78 of the pipe 70 directs the pipe 70 downwardly and slightly forwardly into the engine compartment 44. A flexible pipe 80 is preferably attached to a second end 82 of the pipe 70 and can be sized and positioned to communicate with any desired location within the hull 12.

Of course, it is to be understood that, in some arrangements, the pipe 70 does not include an elbow, or may be bent or directed in any desired orientation. Also, rather than flexible pipe, some arrangements can employ rigid pipe.

With reference also to FIGS. 5–8, port and starboard induction boxes 88, 90 are installed onto the deck adjacent respective air ducts 30. Each air box 88, 90 preferably encloses an interior space 92 which communicates with the first end 72 of the duct 30. More preferably, each induction box 88, 90 is positioned such that it covers the associated opening 72 into the air duct 30. In the illustrated arrangement, each box 88, 90 also has a flanged outer edge 94 that abuts at least a portion of the deck 16.

The outer edge 94 comprises a generally upward-facing edge portion 96 and a generally downward-facing edge portion 98. Mount tabs 100 extend from the outer edge 94 and facilitate attachment of the box 88, 90 to the deck 16 with rivets 102. It is to be understood that other fasteners and other fastening means, such as adhesives, can be used to attach the boxes 88, 90 to the deck 16.

At least a portion of the downward-facing edge portion 98 is spaced a slight distance from the deck 16. With this arrangement, if the watercraft 10 were to capsize and the induction box 88, 90 became filled with water, the water would drain through the slight space 104 once the watercraft 10 were righted. In an additional embodiment, no such space is provided, and the induction box 88, 90 is substantially watertight.

The induction boxes 88, 90 are advantageously sized so as to tune the air intake system to reduce noise associated with air flowing into and out of the ducts 30. That is, the induction boxes 88, 90 are sized so that pressure pulses within the flowing air are dissipated within the boxes 88, 90, which act as pressure reducers, similar to a Helmholtz tuning chamber. This system thus effectively quiets engine and exhaust system noise inducted and emitted through the ducts.

The induction boxes 88, 90 are preferrably substantially covered by the cowling 40. A top portion 106 of the cowling 40 extends across a top portion of the deck 16, and side portions 108 of the cowling 40 extend adjacent the boxes 88, 90. Packing materials 110, such as insulation, are positioned between the cowling sides 108 and the induction boxes 88, 90. The packing 110 helps to maintain an appropriate fit of the cowling side 108 relative to the associated induction box 88, 90 and inhibits chattering that may occur because of vibration during watercraft operation. The packing 110 can also help to further dampen audible engine noise and air flow noise.

Figure 5:
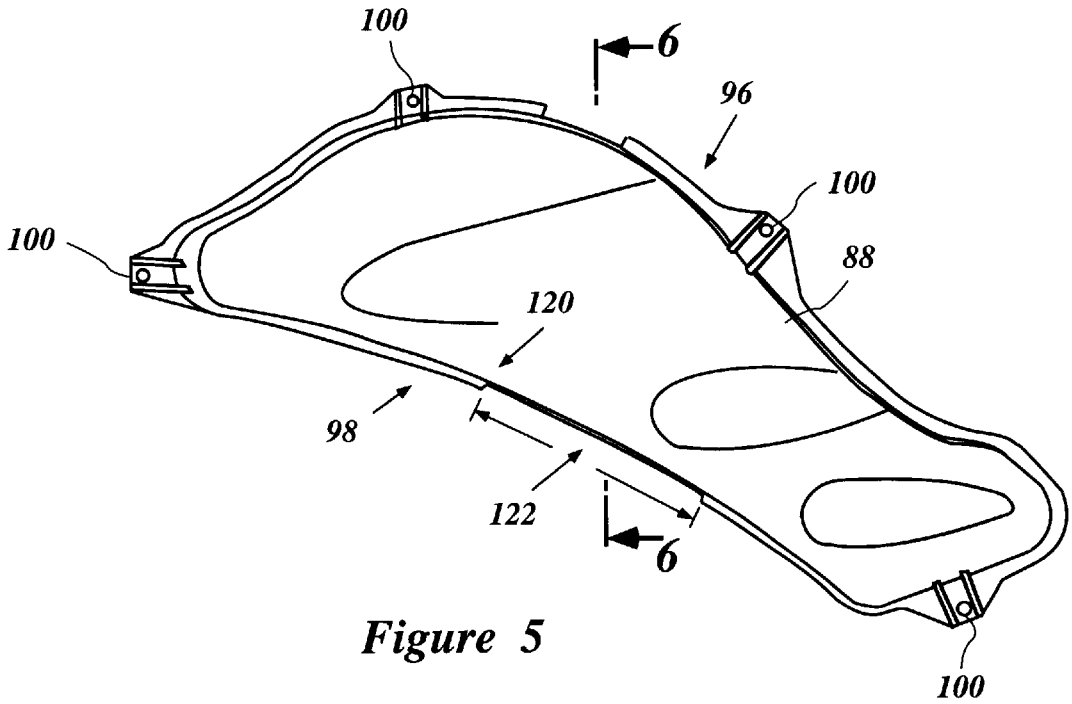
FIG. 5 is side view of a port side induction box of watercraft of FIG. 1.
Figure 6:
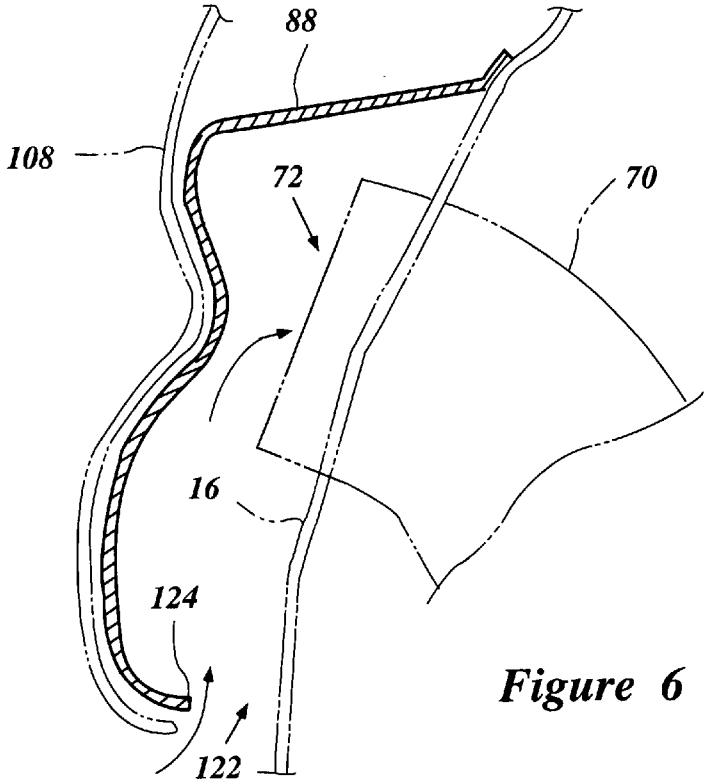
FIG. 6 is a cross-sectional view taken along line 6—6 of FIG. 5.

With more specific reference to FIGS. 5 and 6, a portion of the lower edge portion 98 of the port induction box 88 is cut away, forming a cavity 120 in the induction box lower edge 98. An opening 122 is defined between a cavity edge 124 and the deck 16. The opening 122 faces generally forwardly. Accordingly, when the watercraft 10 moves forwardly at relatively high speeds, dynamic pressure is generated around the opening 122, forcing air through the opening 122 and into the port induction box 88. The air flows from the induction box 88 through the air duct 30 and into the engine compartment 44.

Figure 7:
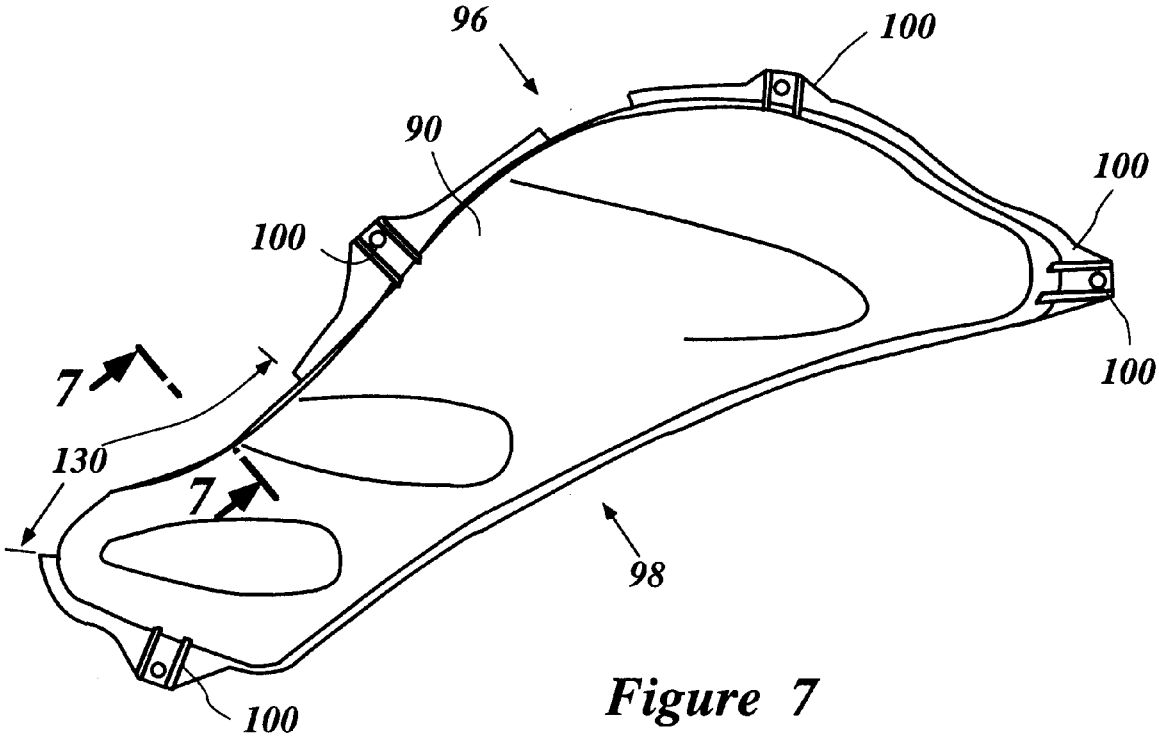
FIG. 7 is a side view of a starboard side induction box of the watercraft of FIG. 1.
Figure 8:
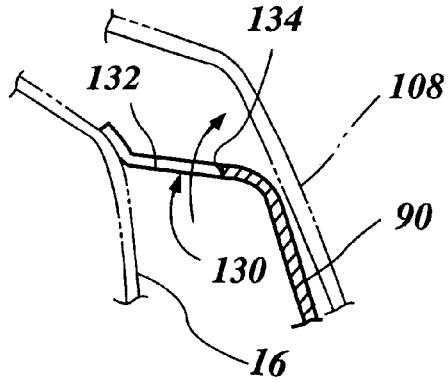
FIG. 8 is a cross-sectional view taken along line 8—8 of FIG. 7.

With more specific reference to FIGS. 7 and 8, a portion of the upper edge portion 96 of the starboard induction box 90 is cut away, forming a a cavity 130. As with the port induction box 88, an opening 132 is defined between a cavity edge 134 and the deck 16. The opening 132 faces generally rearwardly. Accordingly, when the watercraft 10 moves forwardly at relatively high speeds so that air flows quickly around and over the deck 16, a negative pressure is generated around the opening 132, and air inside the starboard induction box 90 is drawn through the opening 132. Air within the hull 14 then flows through the duct 30, into the starboard induction box 90, and out the opening 132.

It is to be understood that when the watercraft 10 is at rest or travelling at substantially slow speeds, the forwardly- and rearwardly-facing orientations of the port and starboard openings 122, 132, respectively, have little or no pressure effect for forcing or drawing air through the openings 122, 132. In such conditions, air flow into or out of the engine compartment 44 can occur through either or both of the air ducts 30.

The present arrangement facilitates ventilation of the engine compartment 44. Thus, air that has been heated by components such as the engine 46 and exhaust system 60 is replaced with relatively cool fresh air from the atmosphere. This leads to a number of advantages. For example, the relatively cool air enables more efficient combustion, as air having a lower temperature allows a greater quantity of the air to be drawn into the combustion chamber during operation. Also, the relatively cool air decreases the temperature within the engine compartment. Since consistent exposure to high temperatures can damage certain engine components, this arrangement helps prolong the working lives of such components.

Although the disclosed embodiment shows the port induction box 88 being arranged to facilitate air intake and the starboard induction box 90 being arranged to facilitate air outflow, it is to be understood that induction boxes having features in common with those of the disclosed embodiment can be configured in a variety of arrangements and combinations. For example, both of the port and starboard induction boxes can be arranged to either intake of evacuate air, while other induction components can be provided to facilitate further ventilation of the engine compartment 44.

In an additional embodiment, a single induction box can have both a forwardly-facing opening, as with the port induction box 88 discussed above, and a rearwardly-oriented opening, as with the starboard induction box 90 also discussed above. The induction box is divided by a wall into two chambers, and each chamber encloses an air duct which extends through the hull and into the engine compartment. In this manner, one induction box can be used both to intake and exhaust air for ventilating compartments enclosed within the hull.

Figure 9:
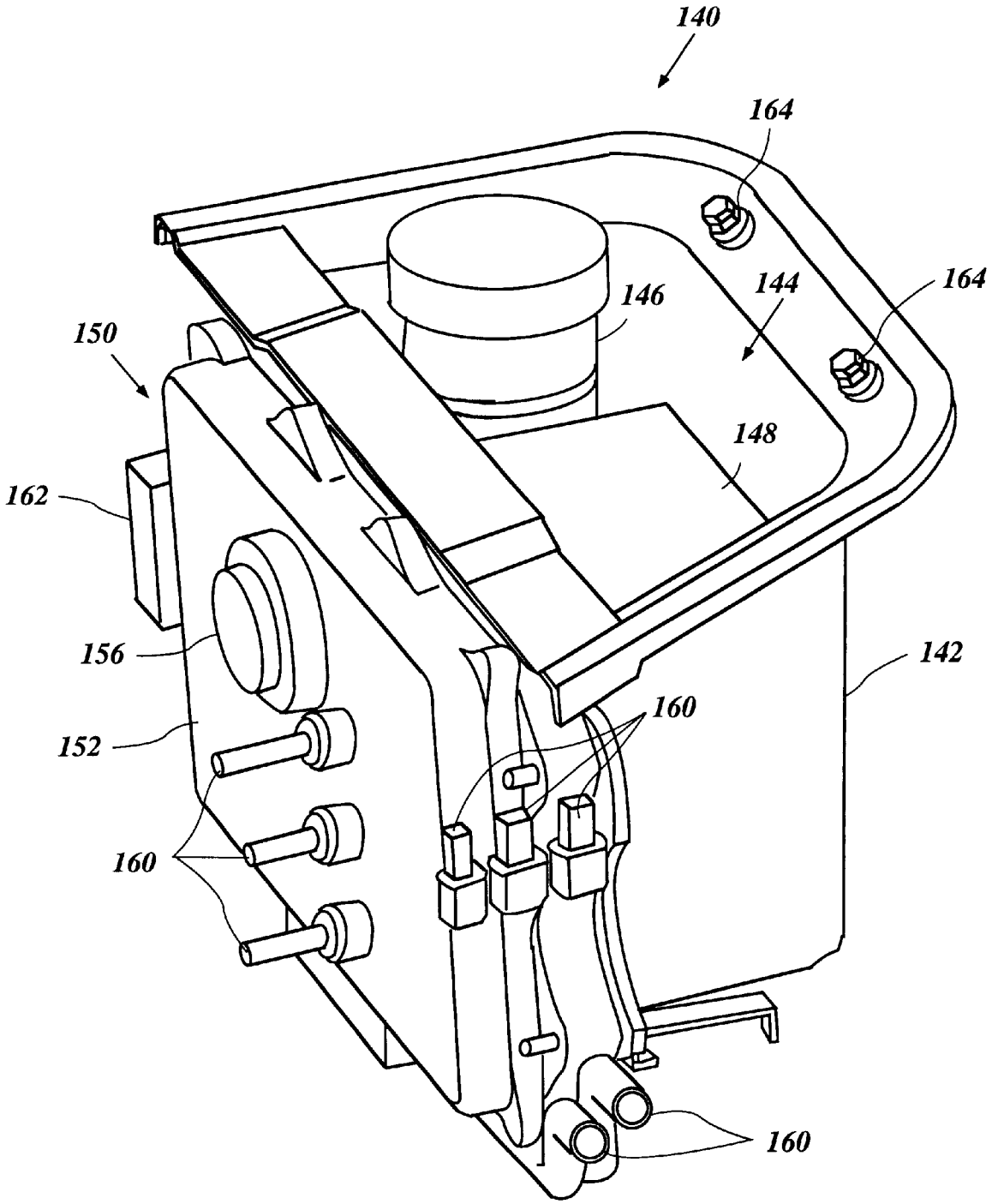
FIG. 9 shows a perspective view of a storage box of the personal watercraft of FIG. 1.

With reference next to FIGS. 1, 2 and 9, a storage box 140 is formed within the hull 12 and under the seat assembly 42. The storage box 140 opens upwardly and is accessible by moving or removing the seat 42. A body 142 of the storage box 140 extends into the engine compartment 44.

A container portion 144 of the storage box 140 preferably comprises a fire extinguisher 146 and a battery 148. An electrical component box 150 is mounted to a forward side 152 of the box 140. The electrical component box 1500 is adapted to include various electrical components and system controls such as relays, fuses and a power source.

In order to perform maintenance, such as changing fuses, the electrical component box 150 comprises a door 154 which is adapted to be opened by turning a knob 156. A plurality of connectors, wires and the like 160 are provided for electronically communicating with and powering various engine components. Cooling fins 162 help to communicate heat away from the electrical box 150, thereby cooling the components therein in order to avoid damage that can be caused by excessive heat.

The storage box 140 is held in place on the hull 12 by fasteners such as bolts 164. It is to be understood that any fastening means, such as rivets, clips, dowels and adhesives can be used to secure the storage box 140 in place on the hull 12. Alternatively, the storage box 140 can be held in place by the seat 42 when the seat is appropriately closed. Also, the storage box 140 is adapted to be removable from the hull 12 as a unit. Thus, maintenance on the battery 158 and electrical components is easily achieved by removing the storage box 140 from the hull 12.

Although this invention has been described in terms of a certain preferred embodiment, other embodiments apparent to those of ordinary skill in the art are also within the scope of this invention. It is also understood that the above-described features and aspects of the invention need not be practiced together. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A watercraft comprising a hull defining an engine compartment, an internal combustion engine located with the engine compartment, an induction box attached to an external side of the hull and defining an interior space, an elongate air duct extending through the hull so that a first end of the air duct opens into the induction box and a second end of the air duct opens into the engine compartment, the induction box having an opening and an edge that abuts the hull, the induction box sized such that pressure pulses of air flowing therethrough are dissipated within the box.

2. A watercraft as in claim 1, wherein the induction box is rigidly secured onto the hull.

3. A watercraft as in claim 1 additionally comprising a cowling attached to the external side of the hull, at least a portion of the cowling extending over at least a portion of the induction box.

4. A watercraft as in claim 3, wherein the induction box is substantially covered by the cowling.

5. A watercraft as in claim 4 additionally comprising packing material disposed between the induction box and the cowling.

6. A watercraft as in claim 1, wherein the opening is generally forwardly facing and is positioned so that air flow directly impinges on the opening when the watercraft moves in a forwardly direction.

7. A watercraft as in claim 6, wherein a watertight seal is effected between an upper portion of the induction box and the hull.

8. A watercraft as in claim 6, wherein a lower portion of the induction box is spaced from the hull.

9. A watercraft as in claim 1, wherein the opening is generally rearwardly facing.

10. A watercraft as in claim 9, wherein a portion of the edge is cut away, and the opening is defined between the cut away portion and the hull.

11. A watercraft as in claim 1, wherein a portion of the edge is cut away, and the opening is defined between the cut away portion and the hull.

12. A watercraft as in claim 11, wherein the cut away portion of the edge comprises an elongate cavity having a cavity edge, and the cavity edge is substantially parallel to the hull adjacent the cavity.

13. A watercraft as in claim 1, wherein a divider is formed within the induction box so that two spaces are enclosed by the box, and at least one air duct opening is disposed in each space.

14. A watercraft comprising a hull defining an engine compartment, an internal combustion engine within the engine compartment, a first and a second air duct extending at least from an opening in the hull into the engine compartment, the first and second air ducts both being positioned at substantially the same longitudinal position relative to the hull, a first induction box defining a first induction space around the first duct and a second induction box defining a second induction space around the second duct, and the first induction box has a forwardly facing opening and the second induction box has a rearwardly facing opening.

15. A watercraft as in claim 14, wherein the first induction box opening is positioned longitudinally forwardly of the second induction box opening.

16. A watercraft as in claim 15, wherein the first and second induction boxes are disposed on opposite sides of a longitudinal center line of the watercraft.

17. A watercraft as in claim 14, wherein the induction boxes are sized so that pressure pulses of air within the induction boxes are dissipated within the boxes.

18. A watercraft as in claim 14, wherein the first and second air ducts each comprise a pipe.

19. A watercraft as in claim 18, wherein the pipe comprises a flange adapted to mountingly engage the deck.

20. A watercraft as in claim 14, wherein the first and second air ducts are disposed forwardly of a control mast of the watercraft.

21. A watercraft as in claim 14, wherein the first induction box opening is positioned so that a portion of air flowing over a bow portion of the watercraft deck directly impinges on the opening.

22. A watercraft as in claim 14, wherein the first and second induction boxes are disposed on opposite sides of a longitudinal center line of the watercraft.

23. A watercraft as in claim 22, wherein the first induction box is at least partially covered by a first cowling member and the second induction box is at least partially covered by a second cowling member.

24. A watercraft as in claim 14, wherein the forwardly-facing opening is positioned so that an air flow directly impinges on the opening when the watercraft is moving forwardly.

25. A watercraft as in claim 14, wherein the rearwardly-facing opening is positioned so that a negative pressure forms adjacent the opening when the watercraft is operated at relatively high speeds.

26. A watercraft as in claim 14 additionally comprising a storage box removably mounted onto the hull and extending into a compartment within the hull.

27. A watercraft as in claim 26, wherein the storage box is positioned underneath a seat assembly of the watercraft.

28. A watercraft as in claim 26, wherein the storage box comprises a container portion adapted to support a battery therein.

29. A watercraft as in claim 26, wherein the storage box comprises an electrical component box mounted thereon, the electrical component box adapted to enclose electrical components therein and adapted to be removable with the storage box.

30. A watercraft as in claim 29, wherein the electrical component box comprises cooling fins.

31. A watercraft as in claim 29, wherein the electrical component box comprises a plurality of contacts adapted to releasably electrically engage wires.

32. A watercraft comprising a hull defining an engine compartment, an internal combustion engine located within the engine compartment, a propulsion device carried by the hull and connected to the engine, an exhaust system for delivering exhaust gases from the engine to the environment, an air duct extending at least from an opening in the hull into the engine compartment, and an induction box rigidly secured onto the hull and defining an interior space, the induction box being substantially covered by a cowling and comprising packing material disposed between the induction box and the cowling, the induction box further having an opening and an edge that abuts the hull.

33. A watercraft as in claim 32, wherein the induction box is rigidly secured onto the hull by rivets.

34. A watercraft as in claim 32, wherein the opening is generally forwardly facing and is positioned so that air flow impinges on the opening at least when the watercraft moves in a forwardly direction.

35. A watercraft as in claim 32, wherein a lower portion of the induction box is spaced from the hull.

36. A watercraft comprising a hull defining an engine compartment, an internal combustion engine located within the engine compartment, a propulsion device carried by the hull and connected to the engine, an exhaust system for delivering exhaust gases from the engine to the environment, an air duct extending at least from an opening in the hull into the engine compartment, and an induction box attached to the hull so that an edge of the induction box generally abuts the hull and a lower portion of the induction box is spaced from the hull, the induction box defining an interior space and having an opening.

37. A watercraft as in claim 36, wherein the opening is generally forwardly facing and is positioned so that air flow impinges on the opening at least when the watercraft moves in a forwardly direction.

38. A watercraft as in claim 36, wherein a divider is formed within the induction box so that two spaces are defined within the box, and at least one air duct opens into each space.

39. A watercraft as in claim 36, wherein the opening is generally rearwardly facing.

40. A watercraft comprising a hull defining an engine compartment, an internal combustion engine located within the engine compartment, a propulsion device carried by the hull and connected to the engine, an exhaust system for delivering exhaust gases from the engine to the environment, an air duct extending at least from an opening in the hull into the engine compartment, and an induction box attached to the hull and defining an interior space, the induction box having a generally rearwardly facing opening and an edge that abuts the hull.

41. A watercraft as in claim 40, wherein a portion of the edge is cut away, and the rearwardly facing opening is defined between the cut away portion and the hull.

42. A watercraft as in claim 40 additionally comprising a second induction box attached to the hull and defining an interior space, the second induction box having a generally forwardly facing opening and an edge that abuts the hull.

43. A watercraft as in claim 42, wherein the watercraft has a longitudinal axis and the first and second induction boxes are disposed on opposite sides of the axis.

44. A watercraft comprising a hull defining an engine compartment, an internal combustion engine located within the engine compartment, a propulsion device carried by the hull and connected to the engine, an exhaust system for delivering exhaust gases from the engine to the environment, an air duct extending at least from an opening in the hull into the engine compartment, and an induction box attached to the hull and defining an interior space, the induction box having an opening and an edge that abuts the hull, a portion of the outer edge being cut away, and the opening being defined between the cut away portion and the hull.

45. A watercraft as in claim 44, wherein the cut away portion of the edge comprises an elongate cavity having a cavity edge, and the cavity edge is substantially parallel to a section of the hull lying adjacent the cavity.

46. A watercraft comprising a hull defining an engine compartment, an internal combustion engine located within the engine compartment, a propulsion device carried by the hull and connected to the engine, an exhaust system for delivering exhaust gases from the engine to the environment, an air duct extending at least from an opening in the hull into the engine compartment, and an induction box attached to the hull and having a divider so as to define a first and a second enclosed space, each enclosed space having an opening and an edge that abuts the hull.

47. A watercraft as in claim 46, wherein a lower portion of the induction box is spaced from the hull.

48. A watercraft as in claim 47, wherein a watertight seal is formed between an upper portion of the induction box and the hull.

49. A watercraft as in claim 46, wherein the induction box is configured so that a flow of air flowing longitudinally front to back adjacent the hull will generate a generally positive pressure about one of the enclosed space openings and a generally negative pressure about the other enclosed space opening.

50. A marine drive comprising an internal combustion engine enclosed within an engine enclosure, the enclosure having a front end, a rear end, and sides between the front and rear ends, and a ventilation system comprising a first air duct extending at least from an opening in one of the sides into the engine enclosure, and a second air duct extending at least from an opening in one of the sides into the engine enclosure, a first induction box disposed on an outer surface of the side and defining a first induction space around the opening of the first air duct, a second induction box disposed on an outer surface of the side and defining a second induction space around the outer opening of the second air duct, the first induction box having a forwardly facing opening and the second induction box having a rearwardly facing opening, the induction boxes configured so that when air flows quickly across the boxes in a front end to rear end direction a positive air pressure is created around the forwardly facing opening and a negative pressure is created around the rearwardly facing opening.

51. The marine drive of claim 50, wherein the the first and second induction boxes are disposed on opposite sides.

52. The marine drive of claim 51, wherein the engine enclosure has a longitudinal axis, and the first and second air ducts extend through the respective sides at generally the same position along the longitudinal axis.

53. The marine drive of claim 51, wherein the first and second air induction boxes are generally symmetrical except for the placement of the forwardly directed and rearwardly directed openings.

54. The marine drive of claim 51, wherein the first induction box opening is positioned longitudinally forwardly of the second induction box opening.

55. The marine drive of claim 50, wherein the engine enclosure is at least partially defined by a watercraft hull.

56. The marine drive of claim 50 additionally comprising a cover attached to the outer surface of the enclosure and extending over at least a portion of the first induction box.

57. A system for ventilating an engine compartment of a watercraft, the compartment having a plurality of sides, the ventilating system comprising a first duct extending into the engine compartment at least from a first opening in one of the sides, a second duct extending into the engine compartment at least from a second opening in one of the sides, a first induction chamber attached to an outer surface of the compartment and generally enclosing the first duct opening, and a second induction chamber attached to the outer surface of the compartment and generally enclosing the second duct opening, the first chamber having a forwardly facing opening and the second chamber having a rearwardly facing opening, and the first and second chambers are configured so that air flowing quickly over the chambers when the watercraft moves forwardly generates a positive pressure around the forwardly facing opening and a negative pressure around the rearwardly facing opening so that air flows into the engine compartment through the first duct and air simultaneously flows out of the engine compartment through the second duct.

58. The system of claim 57, wherein the first and second chambers are enclosed within a single induction box.

59. The system of claim 57, wherein the engine compartment comprises a longitudinal axis, and the first chamber and second chamber are disposed on opposite sides of the axis.

60. The system of claim 59, wherein the first and second chambers are positioned at generally the same position along the axis.

61. The system of claim 60, wherein the forwardly facing opening is disposed longitudinally forwardly of the rearwardly facing opening.

62. A watercraft comprising a hull defining an engine compartment, an internal combustion engine located within the engine compartment, a first elongate air duct extending at least from an opening in the hull into the engine compartment, a second elongate air duct extending at least from an opening in the hull into the engine compartment, and an induction box attached to an outer surface of the hull and defining an interior space, the induction box having a first chamber and a second chamber, the first air duct opening into the first chamber and the second air duct opening into the second chamber, the induction box further having a generally forwardly facing opening that opens into the first chamber, and a generally rearwardly facing opening that opens into the second chamber.

63. The watercraft of claim 62 additionally comprising a cowling attached to the outer surface of the hull and configured so that a space is defined between the cowling and the outer surface, and the induction box is at least partially disposed within the space.

64. The watercraft of claim 63, wherein the induction box is substantially enclosed within the space.

65. The watercraft of claim 62, wherein a lower portion of the induction box is spaced from the hull.

66. The watercraft of claim 62, wherein the forwardly facing opening is disposed longitudinally forwardly of the rearwardly facing opening.

* * * * *

UNITED STATES PATENT AND TRADEMARK OFFICE

CERTIFICATE OF CORRECTION

PATENT NO. : 6,471,558 B1
DATED : October 29, 2002
INVENTOR(S) : Akira Nakatsuji et al.

It is certified that error appears in the above-identified patent and that said Letters Patent is hereby corrected as shown below:

Title page,
Item [75], please correct the spelling of the third inventor's last name to read
-- Koyanagi --.

Signed and Sealed this

Eighteenth Day of February, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,471,558 B1
DATED : October 29, 2002
INVENTOR(S) : Nakatsuji et al.

It is certified that error appears in the above-identified patent and that said Letters Patent is hereby corrected as shown below:

Column 7,
Line 35, change “with” to -- within --.

Signed and Sealed this

Twenty-seventh Day of July, 2004

JON W. DUDAS
*Acting Director of the United States Patent and Trademark Office*